US009309702B2

(12) United States Patent
Hwang

(10) Patent No.: US 9,309,702 B2
(45) Date of Patent: Apr. 12, 2016

(54) DOOR LATCH STRUCTURE

(71) Applicant: Shih-Ming Hwang, Irvine, CA (US)

(72) Inventor: Shih-Ming Hwang, Irvine, CA (US)

( * ) Notice: Subject to any disclaimer, the term of this patent is extended or adjusted under 35 U.S.C. 154(b) by 61 days.

(21) Appl. No.: 14/293,384

(22) Filed: Jun. 2, 2014

(65) Prior Publication Data

US 2015/0097381 A1 Apr. 9, 2015

(30) Foreign Application Priority Data

Oct. 3, 2013 (TW) ..... 102218539 U

(51) Int. Cl.
*E05C 17/04* (2006.01)
*E05C 17/16* (2006.01)
*E05C 17/00* (2006.01)

(52) U.S. Cl.
CPC ..... *E05C 17/166* (2013.01); *E05C 17/16* (2013.01); *Y10T 292/28* (2015.04)

(58) Field of Classification Search
CPC ..... E05C 17/16; E05C 17/166
USPC ..... 292/262
See application file for complete search history.

(56) References Cited

U.S. PATENT DOCUMENTS 372,326 A * 11/1887 Palmenberg ..... E05C 17/166 24/69 R
543,863 A * 8/1895 De Mayo ..... E05C 17/166 292/270
773,579 A * 11/1904 Hair ..... E05C 17/166 292/268
1,286,774 A * 12/1918 Rehe ..... E05B 63/20 292/262
4,062,578 A * 12/1977 Chen ..... E05C 17/166 292/262
4,229,030 A * 10/1980 Tarragona Corbella ..... E05C 17/166 292/270
4,408,789 A * 10/1983 Miller ..... E05C 17/166 292/268
6,343,818 B1 * 2/2002 Kuramochi ..... E05C 17/166 16/65
7,905,525 B2 * 3/2011 Badia ..... E05B 17/007 16/82

FOREIGN PATENT DOCUMENTS

DE 2651190 A1 * 6/1977 ..... E05C 17/166
GB 1030434 A * 5/1966 ..... E05C 17/166
GB 2091340 A * 7/1982 ..... E05C 17/166

* cited by examiner

*Primary Examiner* — Carlos Lugo
(74) *Attorney, Agent, or Firm* — Bacon & Thomas, PLLC

(57) ABSTRACT

A latch structure which includes a fixing mount having a side fixed to a wall and the other side with two protruding pieces that are spaced with a first spacing; a base having a side fixed to a door panel that is pivotally embedded in the wall and able to be opened or closed, and the other side with an extending bent portion; a movable body in a U-shape hinged to each of the protruding pieces, respectively, and having a gap formed therein and a second spacing between two ends thereof; and a pivoting locking portion pivotally mounted to the end of the bent portion away from the base, having a configuration and size smaller than the first and second spacings but greater than a width of the gap, and combined with a protruding lever in a length greater than the smaller of the spacings.

4 Claims, 8 Drawing Sheets

DOOR LATCH STRUCTURE

FIELD OF THE INVENTION

The present invention relates to a door latch structure, more particularly to a swing bar door guard latch structure installed between a wall and a door panel pivotally embedded into the wall. This door latch structure cannot be pried open from the outside by using a custom made tool or foreign object when the door guard is latched and the door is opened slightly.

BACKGROUND OF THE INVENTION

Generally, people will usually install a door guard latch between a wall and a door panel pivotally embedded into the wall in order to improve the security of their residence. A conventional door guard latch 1 is illustrated in FIG. 1 and FIG. 2 and can be assembled to and between a wall 21 and a door panel 22, wherein the door panel 22 is usually pivotally fixed to the wall 21 by one or more hinges 221 so that the door panel 22 can be opened or closed with respect to the wall by a user. The latch 1 includes a fixing mount 11 and a base 13. The rear side of the fixing mount 11 would be fixed to the wall 21. The front side of the fixing mount 11 includes two protruding pieces 111, and the protruding pieces 111 are spaced by a first spacing L1. The fixing mount 11 is further assembled with a movable member 15 in a U shape and having a gap 151 therein. The two corresponding ends of the moveable member 15 are spaced by a second spacing L2 and can be attached to each of the protruding pieces 111, respectively, so that the movable member 15 can be rotated on the protruding pieces 111 of the fixing mount 11. Furthermore, the rear side of the base 13 is fixed to the door panel 22 on the same side of the door panel 22 as the fixing mount 11 and opposite the hinge 221. The front side of the base 13 includes a bent portion 131 extending out and curved in the direction of the fixing mount 11, and the end of the bent portion 131 away from the base 13 is provided with a sphere 133. When the door panel 22 is closed and the movable member 15 has been rotated towards the base 13, the bent portion 131 can extend into and through the gap 151 so as to let the sphere 133 fit into the second spacing L2.

In FIG. 1 and FIG. 2, the size of the sphere 133 is smaller than the second spacing L2 and larger than the width of the gap 151. Therefore, when the movable member 15 is intersected with the bent portion 131, if a person attempts to open the door panel 22, the sphere 133 would slide from the second spacing L2 position into the gap 151, with the sphere 133 sticking out from the gap 151, creating a locking position with the movable member 15 and preventing the door panel 22 from being opened. Thus, a homeowner can prevent an outsider from forcing the door panel 22 open to get inside the house. However, after long-term research, the inventor found that the conventional door latch 1 still has a certain degree of risk even though the latch has the recited safe effects, especially when the door panel 22 is only slightly opened so that the sphere 133 hasn't completely entered the gap 151 of the movable member 15. As shown in FIGS. 3 and 4, the door panel 22 can be easily opened when an outsider inserts a foreign object 25 (such as an extended metal sheet) between the wall 21 and the door panel 22 (as shown in FIG. 3) to push against the movable member 15. Then, the movable member 15 can be rotated away from the base 13 (as shown in FIG. 4) so that the sphere 133 cannot be embedded and stuck within the gap 151 of the movable member 15 with the result that the door panel 22 can be easily opened allowing an intruder to gain entry.

In summary, for people with a greater concern for safety, the conventional door latch cannot meet their needs. Therefore, an important goal for those who are working in the security field is to resolve the aforementioned problems, finding a solution which significantly improves the protective effect of the door latch, thus preventing the door latch from being pried open from the outside with a foreign object when the door panel is opened slightly.

SUMMARY OF THE INVENTION

In view of the conventional door guard latch that has the problem of being maliciously opened, long-term research and experiment has finally resulted in the development of the present invention of a door latch that is expected to provide significantly increased protection.

The present invention provides a door latch structure which cannot be pried open from the outside by someone using a foreign object when the door panel is opened slightly. The latch structure includes a fixing mount, a base, a movable body, and a locking portion. The rear side of the fixing mount would be fixed to a wall. The front side of the fixing mount has two protruding pieces spaced by a first spacing. The movable member is U-shaped with a gap therein and is attached to the fixing mount between the two protruding portions so that the moveable member can be pivoted on the fixing mount. A second spacing is spaced between two corresponding ends of the movable member. The door panel is pivotally connected to the wall by at least one hinge and is able to be opened or closed with respect to the wall by a user. The rear side of the base is fixed to a door panel. The front side of the base extends out and is formed with a bent portion curved in the direction of the fixing mount. Therefore, the bent portion is able to extend into and through the gap when the movable member is pivoted towards the base and flat against the door. The locking portion is attached to the end of the bent portion of the base and has a width that is smaller than the first and second spacings, but greater than the width of the gap. The front side of the locking portion has a pivoting protruding lever which, when pivoted to extend perpendicular to the orientation of the gap in the moveable member, extends the width of the locking portion to be greater than the smaller of the first and second spacings of the assembled fixing mount and moveable member. Thereby, when the bent portion is extended into and through the gap and the protruding lever is pivoted to be perpendicular to the orientation of the gap in the movable member, if the user opens the door panel, the bent portion of the base with the locking portion and protruding lever is moved into the gap so that the bent portion is trapped in the gap. Thus, the door panel can only be partially rotated and opened within the range of the length of the gap. Thus, the movable member cannot be pushed by a foreign object (eg: a thin piece of metal) to disengage the movable member from the bent portion when the door panel is opened slightly.

Another objective of the present invention is that, when the door panel is in a closed state and the protruding lever is rotated to a position parallel to the orientation of the gap in the moveable member, since the locking portion is smaller than the first and second spacings, the bent portion is able to disengage from the movable member. Thereby, the door panel can be completely opened, so that the user need only to adjust the position of the protruding lever to either open the door panel or keep the door panel in a slightly-opened state without being completely opened and yet at the same time be secure in knowing that the moveable lever cannot be manipulated by someone outside to defeat the door latch and enter the premises.

In order to facilitate the examiner in knowing and understanding the objectives of the present invention with its technical features and their effects, the following illustrations are provided:

DESCRIPTION OF THE PREFERRED EMBODIMENT

Figure 1:
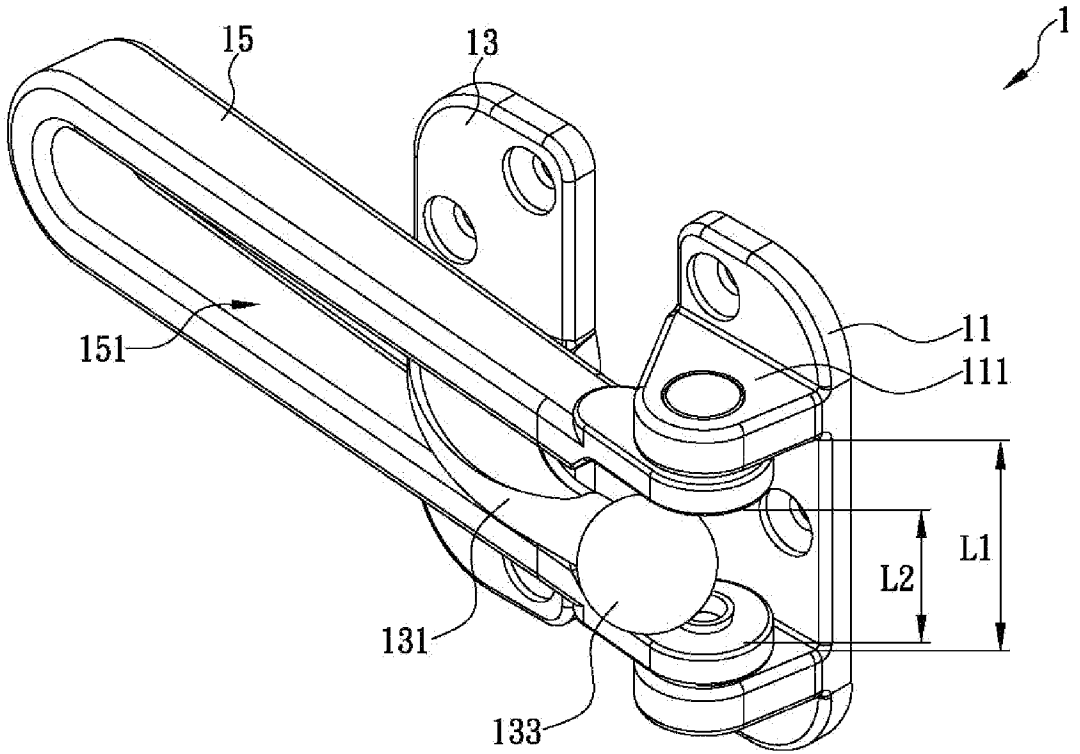
FIG. 1(Prior Art)
FIG. 1 is a schematic of a conventional door latch shown in perspective.
Figure 2:
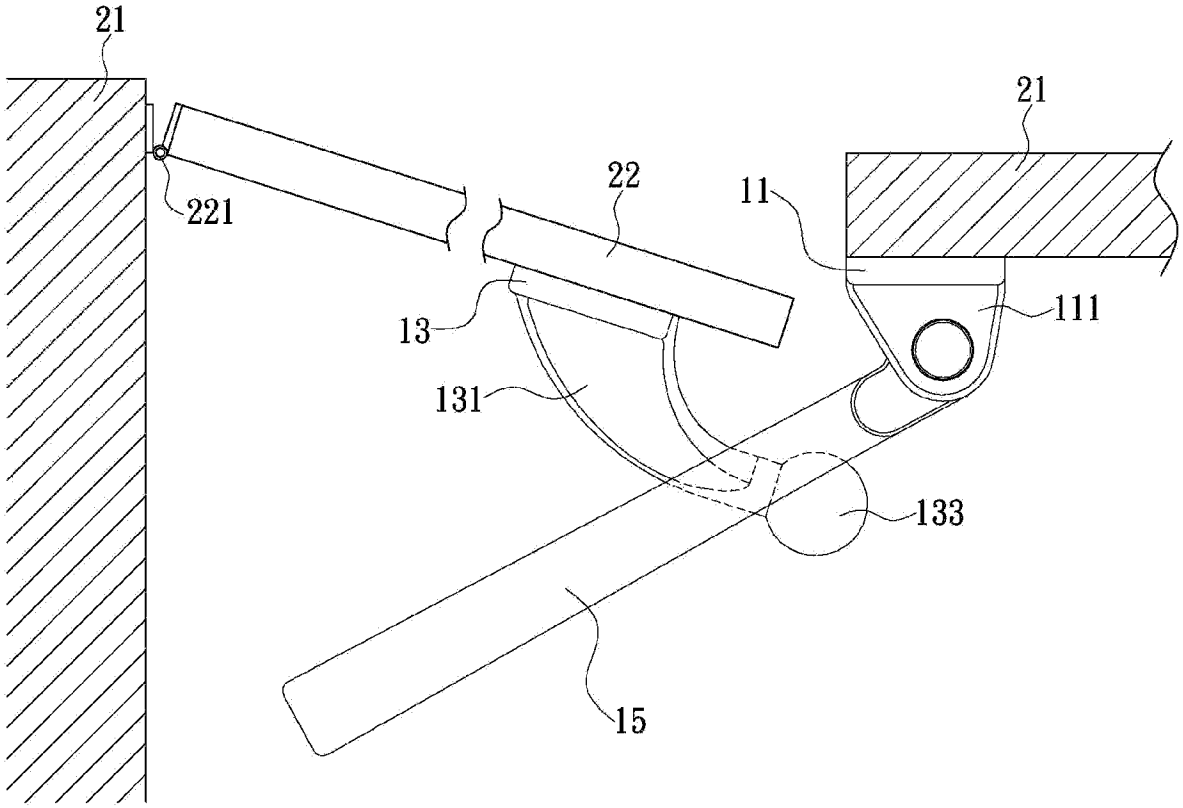
FIG. 2(Prior Art)
FIG. 2 is a schematic of the conventional door latch shown from the top.
Figure 3:
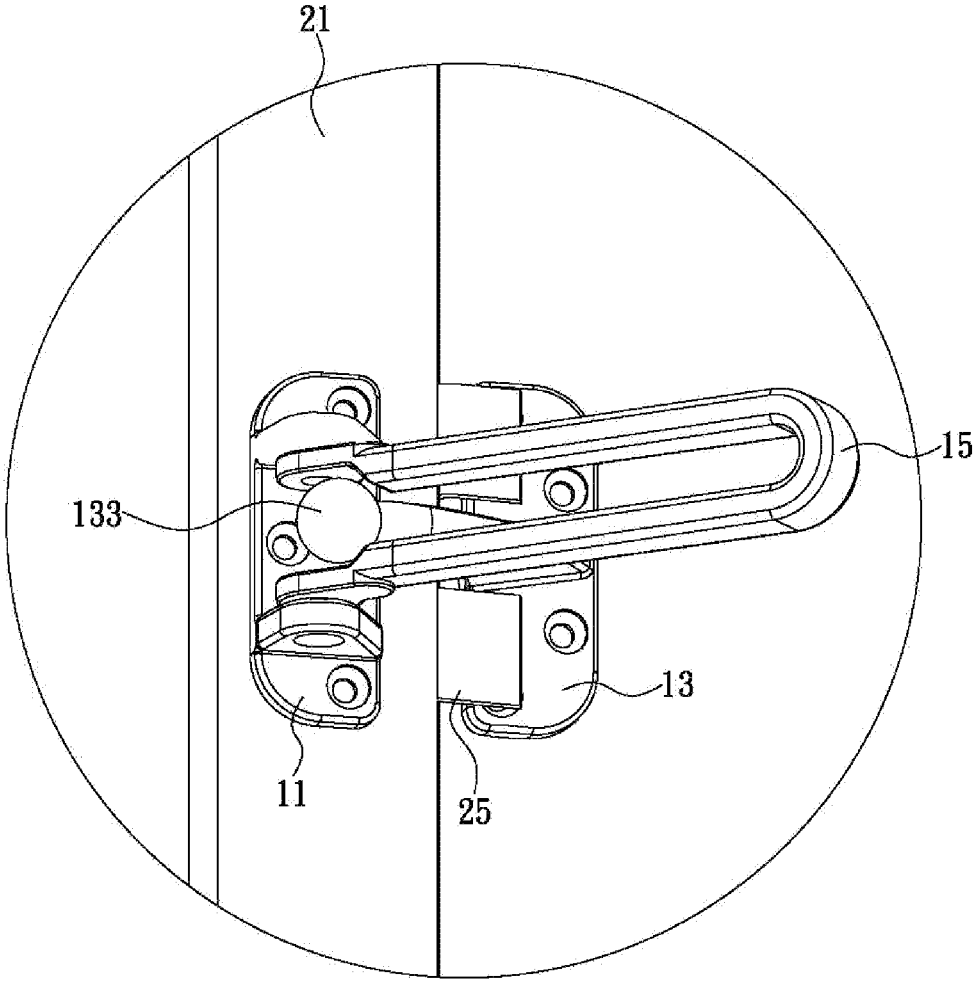
FIG. 3(Prior Art)
FIG. 3 is a first state schematic of a metal sheet being used to push open a conventional door latch.
Figure 4:
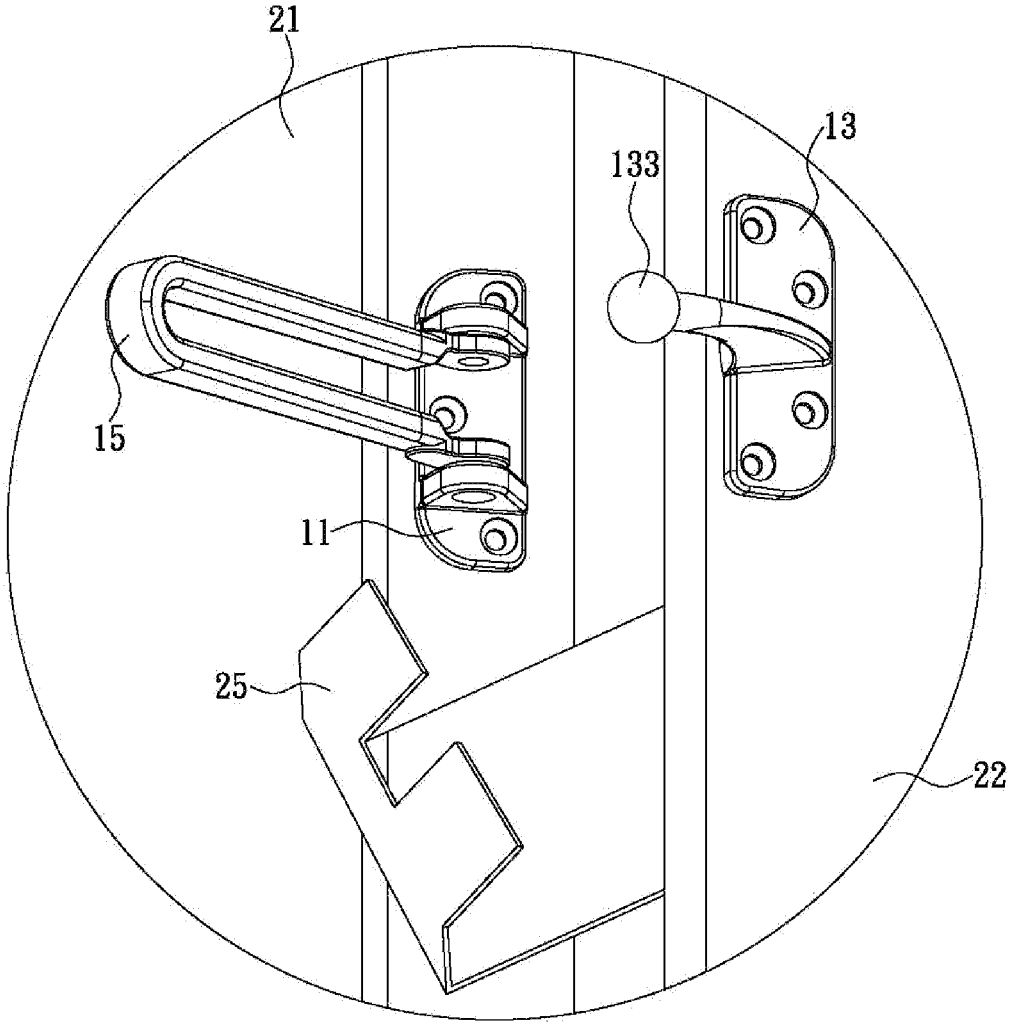
FIG. 4(Prior Art)
FIG. 4 is a second state schematic of a metal sheet being used to push open a conventional door latch.
Figure 5:
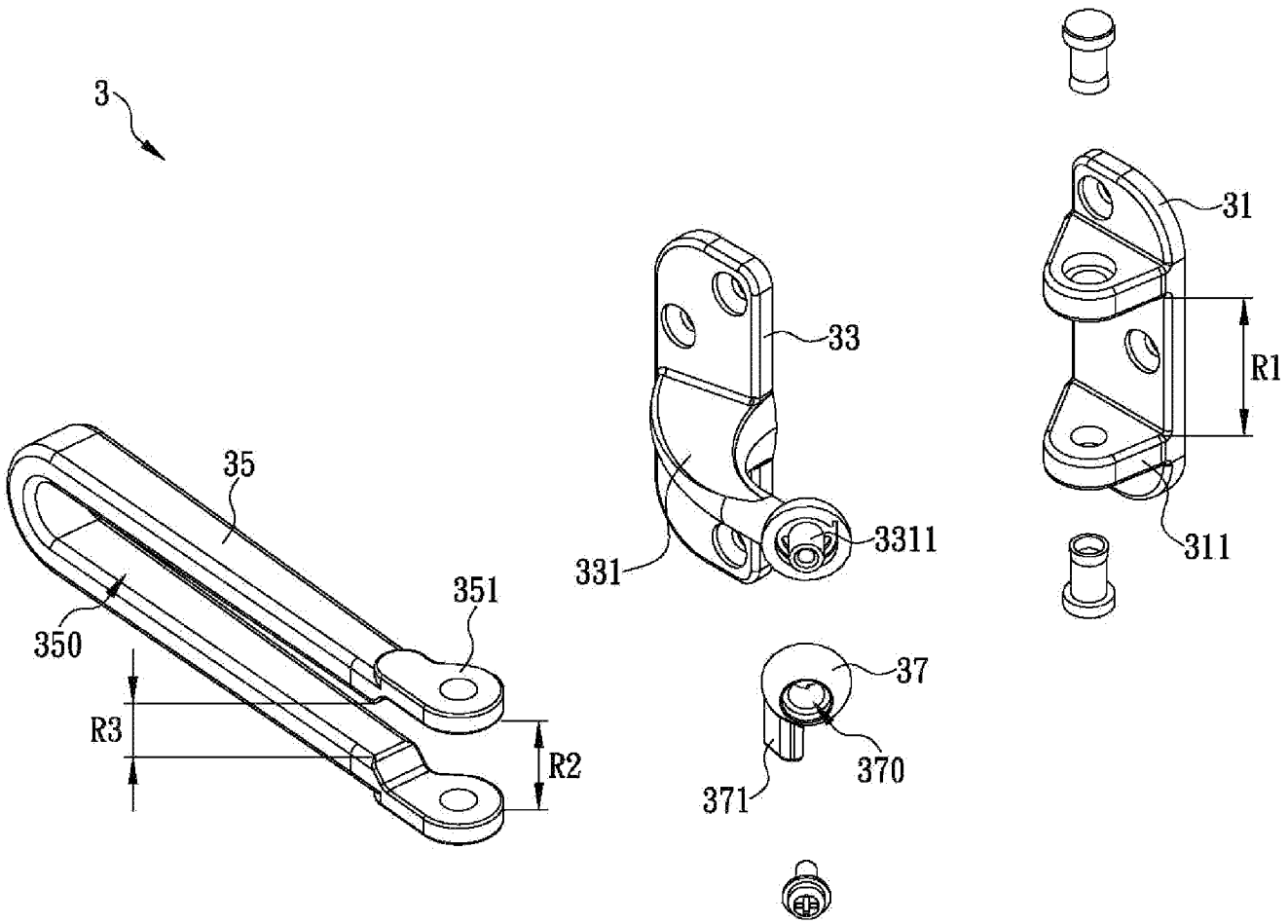
FIG. 5 is a perspective exploded schematic of the door latch structure of the present invention.

The present invention provides an improved door latch structure. Please refer to FIGS. 5-8 which show an embodiment of the present invention. The latch structure 3 comprises a fixing mount 31, a base 33, a movable member 35, and a locking portion 37. The rear side of the fixing mount 31 is fixed to a wall 41, and the front side of the fixing mount 31 includes two protruding pieces 311. The two protruding pieces 311 are separated by a first spacing R1. The rear side of the base 33 is fixed to a door panel 42, and the door panel 42 is pivotally embedded in the wall 41 attached by at least one hinge 421. By being pivoted with the hinge 421, the door panel 42 can be opened or closed with respect to the wall 41 by a user. The front side of the base 33 extends out with a bent portion 331 curved toward the fixing mount 31. In this embodiment, the end of the bent portion 331 away from the base 33 is provided with a first connector 3311. However, the aspects of the first connector 3311 can be changed according to different product needs in other embodiments of the present invention.

Refer again to FIG. 5-8. The movable member 35 is U-shaped and has two corresponding ends separated by a second spacing R2. The movable member 35 is formed with a gap 350 inside, and the width R3 of the gap 350 is smaller than the second spacing R2 but greater than the width of the bent portion 331. The two corresponding ends of the movable member 35 are attached to each of the protruding pieces 311 of the fixing mount 31, respectively in such a way as to allow them to be rotated. Thereby, the bent portion 331 is able to extend into and through the gap 350 when the movable member 35 is pivoted towards and over the base 33. In this embodiment, the second spacing R2 is smaller than the first spacing R1 so that the two corresponding ends of the movable member 35 are hinged to the inner sides of the protruding pieces 311. In other embodiments of the present invention, the second spacing R2 can be designed to be greater than the first spacing R1 so that the two corresponding ends of the movable member 35 are hinged to the outer sides of the protruding pieces 311.

Figure 6:
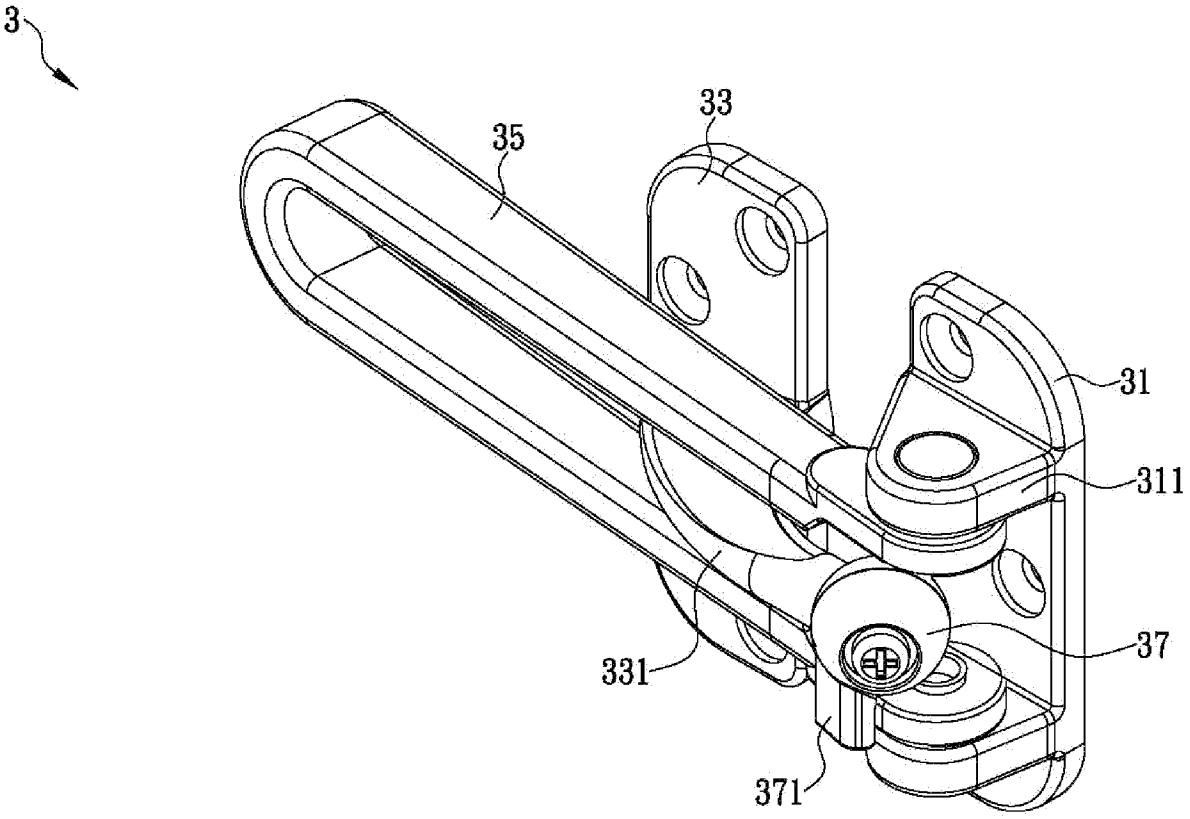
FIG. 6 is a perspective assembled schematic of the door latch structure of the present invention.
Figure 7:
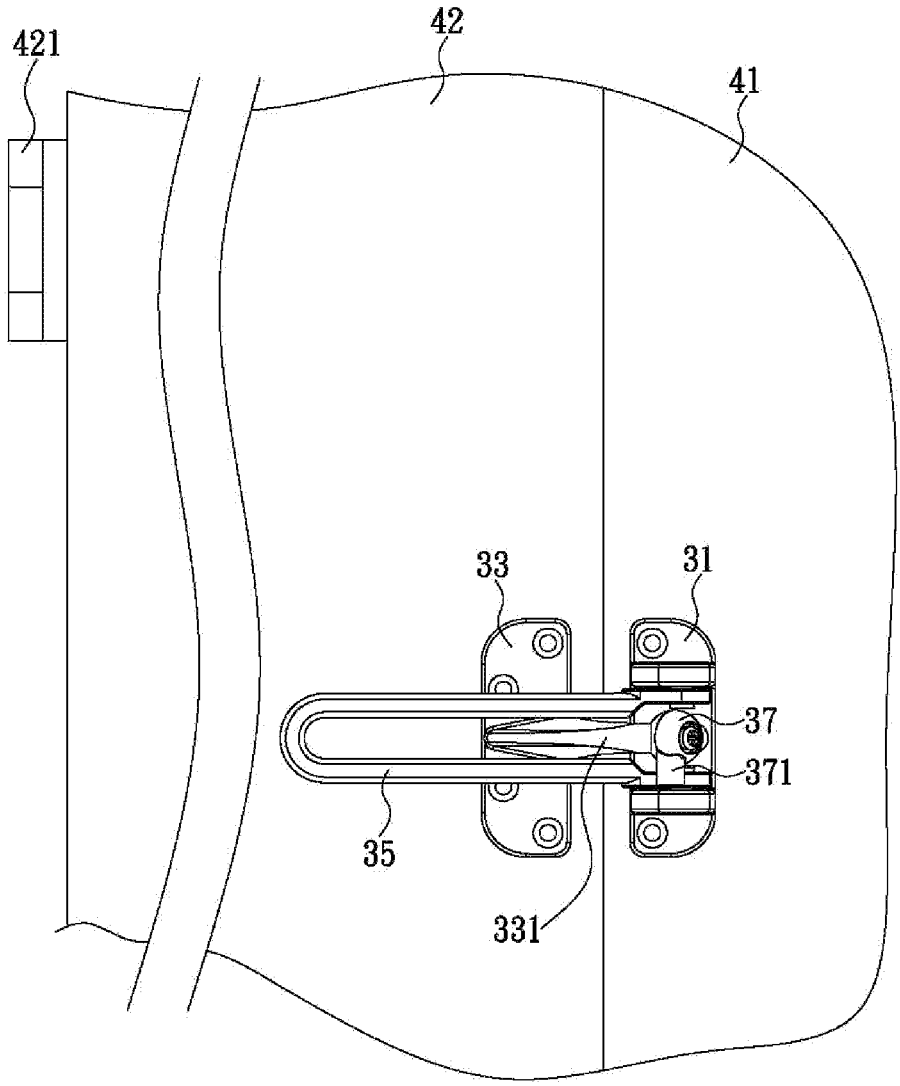
FIG. 7 is a schematic of the door latch structure of the present invention showing the protruding lever of the locking portion pivoted to the secure, perpendicular position.
Figure 8:
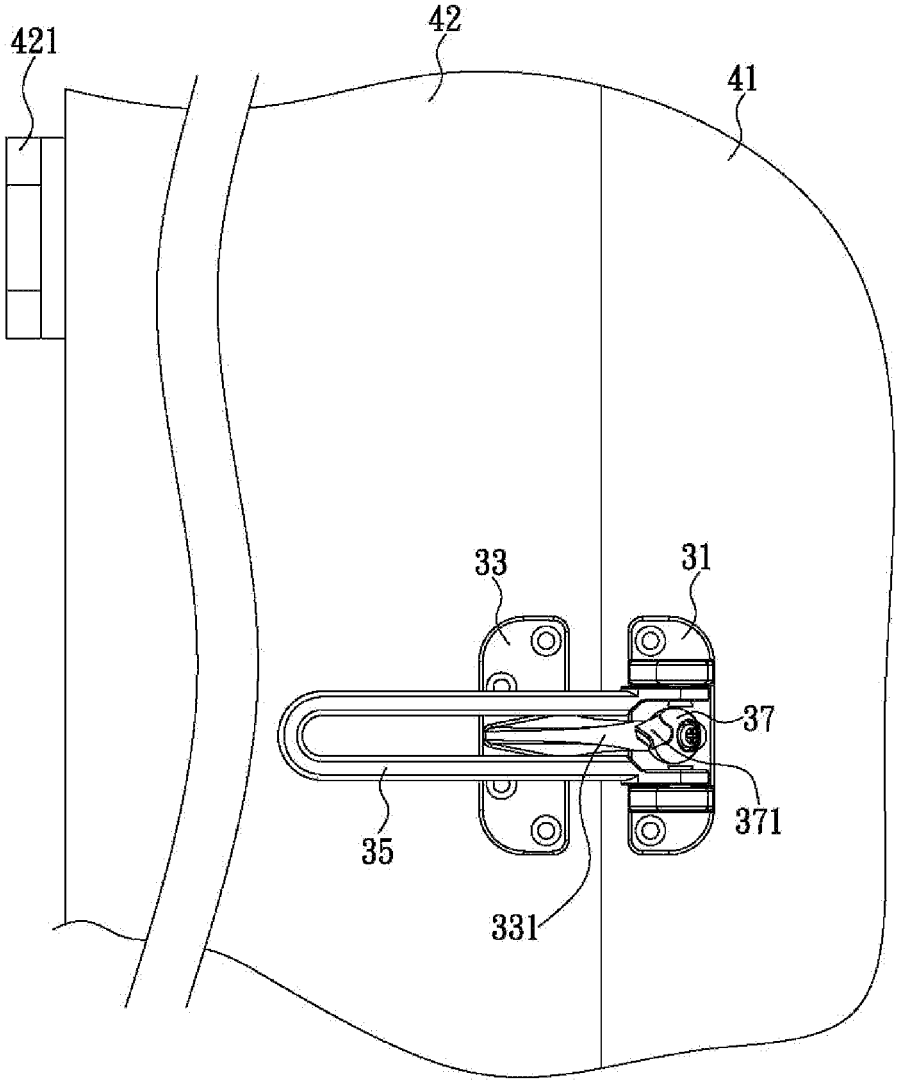
FIG. 8 is another schematic of the door latch structure of the present invention showing the protruding lever of the locking portion pivoted to the less secure parallel position.

Furthermore, please continue to refer to FIGS. 5-8. The rear side of the locking portion 37 is provided with a second connector 370 corresponding to the first connector 3311, and the front side of the locking portion 37 has a protruding lever 371. The second connector 370 is pivotally connected to the first connector 3311 so that the locking portion 37 is attached to the end of the bent portion 331 away from the base 33 in such a way so as to allow it to pivot. The width of the locking portion 37 is smaller than the spacings R1 and R2 when the movable member 35 is oriented parallel to the bent portion 331 but greater than the width R3 of the gap 350. When the bent portion 331 extends into and through the gap 350, the locking portion 37 can fit inside the spacings R1 and R2. The length of the locking portion 37 together with the protruding lever 371 when the protruding lever 371 is pivoted to be perpendicular to the bent portion 331 is greater than the smaller of the spacings R1 and R2. In this embodiment, as shown in FIG. 7, since the width of the locking portion 37 and the protruding lever 371 is greater than the second spacing R2, when the locking portion 37 is pushed and moved to a position corresponding to the hinged end of the movable member 35, the door panel 42 can be opened and the bent portion 331 moving the base 33 towards the end of the moveable member 35 opposite the hinged end. While the door panel 42 is being opened, since the configuration and the size of the locking portion 37 is larger than the width R3 of the gap 350, the locking portion 37 will remain embedded in the gap 350 so that the bent portion 331 cannot be disengaged from the movable member 35. Thereby, the door panel 42 can only be partially rotated and opened within the range of the length of the gap 350 and cannot be manipulated and disengaged should an outsider insert a foreign object (such as a thin piece of metal) between the wall 41 and the door panel 42. In this embodiment, as shown in FIG. 8, since the width of the locking portion 37 is less than the second spacing R2, when the locking portion 37 is in a position corresponding to the hinged end of the movable member 35, the protruding lever 371 is rotated to be parallel to the movable member, and the movable member 35 is rotated so that it lies parallel to the door panel 42, the door panel 42 can be partially opened, which causes the bent portion 331 to move towards the end of the movable member 35 opposite the hinged end. While the door panel 42 is thus opened, since the width of the locking portion 37 is larger than the width R3 of the gap 350, the locking portion 37 will remain embedded in the gap 350 so that the bent portion 331 cannot be disengaged from the movable member 35. Thereby, the door panel 42 can only be partially rotated and opened within the range of the length of the gap 350. However, should an outsider insert a foreign object such as thin piece of metal between the door panel 42 and wall 41 when the door panel 42 is only partially rotated away from the wall 41, it may be possible to use that thin piece of metal to push the movable member 35 away from its position parallel to the door panel 42, thereby putting the locking portion 37 outside the gap 350 and allowing the door panel 42 to be fully rotated open, defeating the purpose of the latch structure 3.

However, as shown in FIG. 6-7, when the locking portion 37 is in a position corresponding to the hinged end of the movable member 35, the protruding lever 371 is rotated to be perpendicular to the movable member, and the movable member 35 is rotated so that it lies parallel to the door panel 42, if the door panel 42 is in a slightly opened state and a thin piece of metal is pushed against the movable member 35, the movable member 35 would be blocked by the protruding lever 371 from being disengaged from the bent portion 331. This mechanism effectively ensures that the latch structure 3 cannot be maliciously opened.

Referring again to FIGS. 5-8, when the user wants to completely open the door panel 42, the protruding lever 371 can be pivoted to a position parallel to the gap 350 as shown in FIG. 8. In this orientation, since the width of the locking portion 37 and the protruding lever 371 is smaller than either of the spacings R1 and R2, the user can then rotate the movable member 35 to disengage the bent portion 331 from the movable member 35 so that the door panel 42 can be completely rotated and opened. In summary, when the user closes the door panel 42 and rotates the movable member 35 in the direction of the door panel 42 and over the base 33, thus allowing the bent portion 331 to extend into and through the gap 350, the protruding lever 371 of the locking portion can then be rotated to an orientation perpendicular to the movable member 35. When the door panel 42 is in a state of being slightly opened, an outsider cannot easily use a foreign object to rotate the protruding lever 371 or push the movable member 35. In other words, the locking portion 37 as well as the protruding lever 371 attached to the bent portion 331 will be embedded in the gap 350 of the moveable member 35 and will be unable to be disengaged from the moveable member 35. When the user needs to normally open the door panel 42, the user only has to rotate the protruding lever 371 to a position parallel to the gap 350, at which point the movable member 35 can then easily be disengaged from the bent portion 331. Therefore, the user only needs to perform a simple operational step, i.e. rotate the protruding lever 371 to the position perpendicular to and against one end of the movable member 35, to prevent the door latch structure from being maliciously opened by an outsider through using a foreign object. The safety of the door latch structure 3 is highly improved.

While the invention herein disclosed has been described by means of specific embodiments, numerous modifications and variations could be made thereto by those skilled in the art without departing from the scope of the invention set forth in the claims.

What is claimed is:

1. A door latch structure, comprising:

a fixing mount having a side fixed to a wall and the other side with two protruding pieces that are spaced by a first spacing;

a base having a side fixed to a door panel that is pivotally connected to the wall by at least one hinge and can be opened or closed, and the other side of the base extending out and formed with a bent portion curved in a direction towards the fixing mount;

a movable member in U-shape having a gap formed therein, wherein two corresponding ends of the movable member are spaced by a second spacing and hinged to each of the protruding pieces of the fixing mount respectively, so that a free end of the bent portion away from the base is able to extend into and through the gap when the movable member is rotated towards the base; and a locking portion having a rear side pivotally connected to the free end of the bent portion and having a configuration and a size smaller than the first and second spacings but greater than the width of the gap, wherein, the locking portion is able to extend into the spacings, a front side of the locking portion has a protruding lever, and the length of the locking portion and the protruding lever is greater than the smaller of the spacings;

whereby, when the locking portion along with the free end of the bent portion is within the spacings and the protruding lever is rotated to a position perpendicular to the orientation of the gap, the bent portion moves into the gap while the door panel is being opened, and the locking portion and the protruding lever prevents the bent portion from being disengaged from the movable member; when the door panel is in a closed state and the protruding lever is rotated to a position parallel to the gap, the bent portion is able to be disengaged from the movable member since the locking portion is smaller than the spacings.

2. The door latch structure as claimed in claim 1, wherein the free end of the bent portion away from the base is provided with a first connector, the rear side of the locking portion is provided with a second connector, and the second connector can be pivotally connected to the first connector.

3. The door latch structure as claimed in claim 2, wherein the first spacing is greater than the second spacing.

4. The door latch structure as claimed in claim 2, wherein the first spacing is smaller than the second spacing.

* * * * *